US005664288A

United States Patent [19]

Lautenschläger et al.

[11] Patent Number: 5,664,288

[45] Date of Patent: Sep. 9, 1997

[54] FURNITURE HINGE

[75] Inventors: Horst Lautenschläger; Reinhard Lautenschläger, both of Reinheim, Germany

[73] Assignee: MEPLA-Werke Lautenschläger GmbH & Co. KG, Germany

[21] Appl. No.: 725,340

[22] Filed: Oct. 1, 1996

[30] Foreign Application Priority Data

Jul. 18, 1996 [DE] Germany ..... 296 12 358.7

[51] Int. Cl.[6] ..... F05D 7/04

[52] U.S. Cl. ..... 16/249; 16/272; 16/237

[58] Field of Search ..... 16/249, 272, 248, 16/382, 237, 238

[56] References Cited

U.S. PATENT DOCUMENTS 5,245,727 9/1993 Sasaki ..... 16/382

FOREIGN PATENT DOCUMENTS 2649047 5/1978 Germany ..... 16/249

637725 8/1983 Germany ..... 16/249

*Primary Examiner*—Chuck Y. Mah

*Assistant Examiner*—Mark Williams

*Attorney, Agent, or Firm*—Londa and Traub LLP

[57] ABSTRACT

A furniture hinge (10) with a door-related hinge member, which is constructed as a hinge pot (18) that can be inserted countersunk in a recess (16) on the inside of the door leaf (12) and is composed of a pot part (20), lying within the recess, and a fastening flange (22), which can be placed upon the region of the inside of the door leaf, adjoining the door leaf recess (16), and can be fastened to the back side of the door leaf (12) by fastening means engaging the material of the door leaf (12) in the specified fastening position of the door leaf (12), the pot part (20), engaging the recess (16), being dimensioned smaller than the recess (16) in the door leaf (12) in such a manner, that, in the unfastened state, it can be shifted in the recess by a specified amount at least at right angles to the border edge of the door leaf (12). The pot part (20) and the fastening flange (22) are separately manufactured components, which in each case have plane connecting sections (30; 36) and can be superimposed on one another, brought into contact with one another and shifted relative to one another. In one of the connecting sections (36; 30), a threaded borehole (38) is provided and, in the associated region of the other connecting section (30; 36), an opening is provided, which is dimensioned larger than the diameter of the threaded borehole (38) at least in one adjusting direction. The shaft of a fastening screw (42), which is passed through the opening and presses the connecting sections (36; 30) together when tightened, is screwed into the threaded borehole (38).

11 Claims, 1 Drawing Sheet

FURNITURE HINGE

BACKGROUND OF THE INVENTION

This invention relates to a furniture hinge for the pivotable connection of a door leaf to the carcase of a cabinet, cupboard or wardrobe with a carcase-related hinge member and a door-related hinge member, which is coupled over a joint mechanism with the carcase-related hinge member top. The door-related hinge member is constructed as a hinge pot that can be inserted countersunk in a recess on the inside of the door leaf. Specifically, the invention is composed of the actual pot part, lying within the recess, and a fastening flange, which can be placed upon the region of the inside of the door leaf, adjoining the door leaf recess. The fastening flange can be fastened to the back of the door leaf by fastening means engaging the material of the door leaf at the specified fastening site on the door leaf. The pot part, engaging the recess, is dimensioned smaller than the recess in the door leaf in such a manner, that, in the unfastened state, it can be shifted in the recess by a specified amount at least at right angles to the border edge of the door leaf.

Modern furniture hinges permit the alignment of the closed door leaf to be adjusted relative to the associated carcase of the cabinet, cupboard or wardrobe in at least two and frequently also in three coordinate directions, namely in a horizontal direction parallel to the side wall (depth adjustment), a horizontal direction at right angles to the side wall (adjustment of the extent of impact or overlap) and in the vertical direction (height adjustment). The adjustment possibilities are usually realized structurally in the part of the hinge secured to the carcase, that is, between the carcase related hinge member, which is frequently constructed as an extended supporting arm, and an installation plate, previously mounted at the carcase side wall, which represents the supporting wall. In special cases, it is difficult or even impossible to realize all the desired adjustment possibilities by means of the hinge mounted on the carcase.

For adjusting the extent of the overlapping of the opening door leaf in relation to the front surfaces to the carcase supporting wall, the possibility of adjusting the door leaf stop, constructed as a hinge pot, in the associated recess in the door leaf is realized owing to the fact (U.S. Pat. No. 5,412,841) that the pot part of the hinge pot, which is to be disposed within the recess in the door leaf, is dimensioned so much smaller than the recess, that, when the hinge pot is not yet fastened to the door leaf, the pot part of the hinge pot can be shifted at least in the adjusting direction by the desired, maximum adjusting amount. The space, necessarily existing between the wall of the recess of the door leaf and the pot part is covered by the fastening and covering flange, which is mounted in one piece at the upper edge of the pot part, protrudes radially and is seated on the inside of the door leaf. The hinge pot is fixed at a desired distance from the adjacent border edge of the associated door leaf by means of two fastening screws having threaded shafts. The threaded shafts are screwed through elongated holes in the door leaf, provided on opposite sides in the fastening flange and extending in the adjusting direction. The screws are tightened in order to fix the stop of the door leaf in the desired adjusted position, When the fastening screws are loosened, a change in the position of the hinge pot relative to the door leaf is then possible by shifting the pot part within the recess and subsequently tightening the fastening screws once again. In other words, the adjustment of the door leaf in the horizontal direction requires that two fastening screws at each of the hinges holding the door leaf be loosened and, after the shifting has been accomplished, be tightened. When adjustments are made frequently, it is not impossible that the thread, formed by the shafts of the fastening screws in the door leaf, is stripped and then, in the course of time, sufficiently tight fastening is no longer possible. For the known,hinge, it is therefore proposed that the fastening screws be not screwed directly into the material of the door leaf but be screwed into plastic fastening lugs, which can be expanded by the screws screwed-in in the form of straddling dowels and so can be fixed in the assigned boreholes in the door leaf. Due to the need to loosen two fastening screws for each adjusting process and, after the adjustment has been made, to tighten them once again, the adjusting process is relatively labor intensive.

SUMMARY OF THE INVENTION

With this as background, it is the object of the invention to provide a hinge, which has possibilities for adjusting the extent of overlapping or impact. These possibilities are realized structurally in the region of the door related hinge member, which is constructed as a hinge pot. Not only shall the hinge be easily manufactured and inexpensive, but the work required for any adjustments shall also be slight. At the same time, the danger of a deterioration of the fastening due to the wear of or damage to the boreholes in the door leaf, accommodating the fastening screws, shall be avoided.

Starting out from the hinge of the initially mentioned type, this objective is accomplished pursuant to the invention owing to the fact that a pot part and the fastening flange are separately manufactured components, which have plane connecting sections that can in each case be superimposed on one another and brought into contact with one another and shifted relative to one another. In one of the connecting sections, a threaded borehole is provided and, in the associated region of the other connecting section, an opening is provided, which is dimensioned larger than the diameter of the threaded borehole at least in one adjusting direction. The shaft of a fastening screw, which is passed through the opening and presses the connecting sections together when tightened, is screwed into the threaded borehole.

Due to the separate manufacturing of the fastening flange and of the hinge pot, the fastening flange need only be fastened once, namely during the first installation, to the inside of the door leaf. This fastening is accomplished either with the conventional fastening screws, which can be screwed directly into the material of the door leaf, or with expandable or overdimensioned fastening lugs, which are previously mounted in boreholes in the door leaf or at the underside of the fastening flange. Should it become necessary to adjust the door leaf, it is merely necessary to loosen the fastening screw, screwed into the threaded borehole in a connecting section, somewhat, whereupon the pot part within the recess in the door leaf can be shifted. When the adjusting process is accomplished the fastening screws are tightened once again. Wear of the thread of the threaded borehole need not be feared since the metallic, threaded shaft of the fastening borehole engages a metallic counterthread in the connecting section.

The opening in one of the connecting sections preferably is constructed as an elongated hole, the width of which is essentially equal to or slightly larger than the diameter of the shaft of the fastening screw.

In relation to the border edge of the associated door leaf facing the carcase, the elongated hole extends in the adjusting direction, that is, at right angles to the border edge of the door leaf.

In an advantageous further development of the invention, the connecting sections of the pot part and of the fastening flange, which can be superimposed on one another, are disposed in the specified installation position in a door leaf so as to be offset, in relation to the rear side of the door leaf, somewhat into the door leaf recess and, on both sides, on the pot part and on the fastening flange, extending at right angles to the border edge of the door leaf on opposite sides of and parallel to the longitudinal extent of the elongated hole, strip-shaped guiding surfaces are provided, which lie in contact with one another, can be shifted relative to one another in a sliding manner and ensure that the pot part can be shifted relative to the fastening flange only in the intended adjusting direction, while a rotation of the two parts relative to one another is precluded.

In order to secure an adjustment made against loosening through jarring or vibrations, etc., it may be appropriate to provide, in the mutually facing flat sides of the connecting sections, projections and depressions which engage one another when the fastening screw is tightened. In a preferred further development of the invention, the projections and depressions can be formed by parallel, complementary furrows, which run at right angles to the adjusting direction and are pointed in cross section.

In an advantageous further development of the invention, the pot part has a central, trough-like, recessed middle part, from the upper edge of which, at least in the region not covered by the fastening flange in the specified fastening position at the door leaf, a plane covering flange protrudes, which covers the space between the central part and the peripheral wall of the recess in the door leaf and lies at least with its radial, outer edge region on the inside of the door leaf. The covering flange serves not only for optically covering the space between the middle part and the boundary wall of the recess, but also transfers forces acting on the door leaf.

The fastening flange can have two fastening flange sections, which protrude on opposite sides of the pot part in relation to the central plane running at right angles to the adjacent front edge of the door leaf and are integrally connected with one another through the connecting section of the fastening flange. The fastening of the hinge pot at the door leaf can be accomplished, for example, by fastening screws, which are screwed into the door leaf through boreholes provided in the fastening flange sections.

The connecting section of the fastening flange has a centering section, which advantageously is offset somewhat in the direction of the bottom of the recess, the boundary wall of the centering section being formed in a partial region complementary to the boundary of the opposite region of the peripheral wall of the recess. During the installation of the hinge pot, the fastening flange is aligned very easily on the back side of the door leaf by inserting the hinge pot into the recess and then pushing it until the boundary wall of the centering section comes to lie against the peripheral wall of the recess.

The connecting section, provided in the pot part, can be constructed as a tab, which is offset in the direction of the connecting section of the fastening flange and constructed to extend parallel to this.

The height offset of the tab in relation to the bottom of the middle part of the pot part is then advisably selected so that the upper side of the tab lies against the underside of the connecting section of the fastening flange, in which case the threaded borehole for the fastening screw, connecting the fastening flange with the pot part, is provided in the tab and the elongated hole is provided in the connecting section of the fastening flange.

BRIEF DESCRIPTION OF THE DRAWINGS

The invention is described in greater detail in the following description of an example in conjunction with the drawing in which.

DETAILED DESCRIPTION

Figure 1:
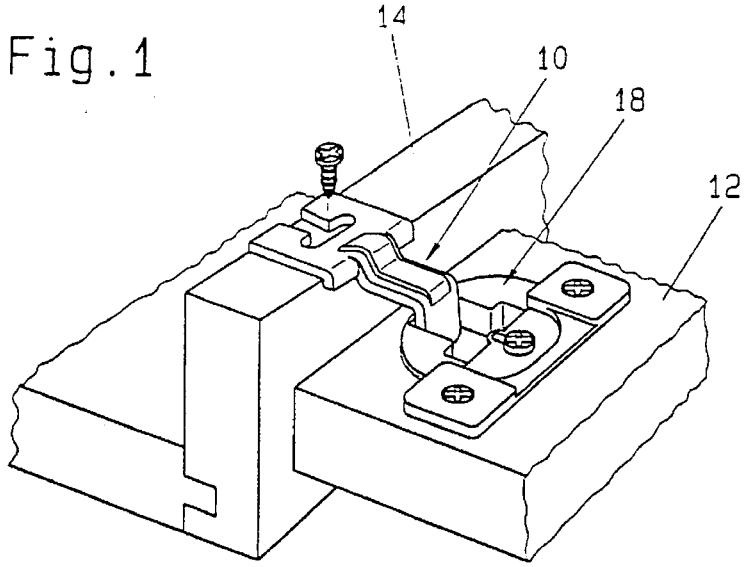
FIG. 1 shows a perspective view of an example of the inventive furniture hinge, with which a door leaf is hinged to the carcase of a cabinet, cupboard or wardrobe.
Figure 2:
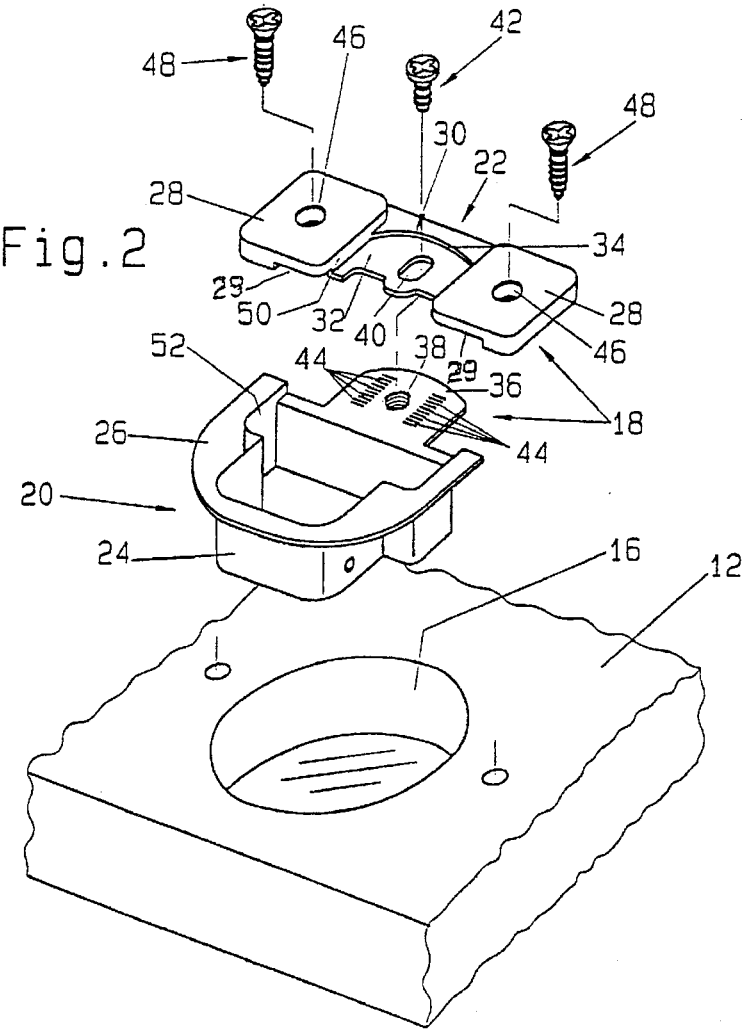
FIG. 2 shows a perspective, exploded representation of the hinge pot of the hinge shown in FIG. 1 above the recess for accommodating the hinge pot in the door leaf.

In FIG. 1, a special single-joint pot hinge, which is labeled 10 as a whole, is shown. Together with at least one further, similar hinge, it serves for pivotally linking a door leaf 12 to the carcase of a cupboard or wardrobe, of which only a section of a side wall of a cabinet, cupboard or wardrobe and a frame strip 14, protruding from this side wall, are shown in the drawing. The further development relative to the state of the art is, however, concerned exclusively with the door-related hinge member, which is constructed as a hinge pot 18, which can be inserted in a circular recess 16 of the door leaf 12. The hinge pot is not limited to the special hinge 10 shown, but can be used for all types of hinges, for which the fastening on the door leaf is accomplished by means of such hinge pots, which are fastened countersunk in the back side of the door leaf. In FIG. 2, therefore, only the hinge pot 18 is shown in an exploded perspective view above the associated recess 16, which is provided in the back side of the door leaf 12.

The hinge pot 18 is composed of two separately produced components, namely the actual pot part 20, which can be inserted in the recess 16, and a fastening flange 22, which can be fastened on the inside of the door leaf 12 in the region adjacent to the recess 16. The pot part 20, produced in the case shown from sheet metal by a stamping method, has a trough-like recessed middle part 24, which is dimensioned so that it fits overall loosely into the recess 16 in the door leaf 12, which is dimensioned larger in depth as well as in diameter. Over the greater part of the periphery, a radially protruding plane covering flange 26 is joined to the upper edge of the trough-like recessed middle part 24. The outer diameter of the covering flange 26 is selected so that, in every conceivable position in which the pot part 20 is shifted within the recess 16, it covers the space remaining between the trough-like recessed middle part 24 and the peripheral wall of the recess 16 and thus also fixes precisely the depth of insertion of the pot part 20 in the recess 16.

The fastening flange 22, also produced separately by a stamping method for the example shown, has two outer fastening flange sections 28, which protrude radially on opposite sides of the pot part and are integrally connected together by an intervening connecting section 30. The connecting section 30 is provided with a centering section 32, which is offset somewhat in the direction of the bottom of the recess 16 and the boundary wall 34 of which, forming the transition to the remainder of the connecting section, is formed in a partial region, which lies opposite the front edge of the door leaf 12 and is complementary to the boundary of the associated region of the peripheral wall of the recess 16, so that the boundary wall 34, when the fastening flange 22 is fastened to the inside of the door leaf 12, can be aligned exactly with respect to the recess 16, in that the boundary wall 34 is guided to lie in contact with the peripheral wall in recess and then fastened.

Under the centering section 32 of the connecting 30, a tab 36 is cut at the pot part 20. Compared to the bottom of the pot part 20, the tab 36 is offset upwards to such an extent, that its plane upper surface comes to lie against the associated plane underside of the centering section 32. In the tab 36, forming the connecting section of the pot part 20, a threaded borehole 38 is provided, into which the shaft of a fastening screw 42, passing through an elongated hole 40 in the centering section 32, can be screwed. When the fastening screw 42 is tightened, the mutually facing flatsides of the tab 36 and the centering section 32 are pressed together and, by these means, are connected together immovably relative to one another. An additional safeguard against sifting of the pot part 20 relative to the fastening flange 22 is provided by furrows 40, which are provided in the upperside of the tab 36 and extend transversely to the longitudinal hole 40 and the corresponding furrows in the underside of the centering section 32, which are not shown. On the other hand, when the fastening screw 42 is loosened, the pot part 20 can be shifted relative to the fastening flange 22 to the extent specified by the longitudinal extent of the elongated hole 40.

The fastening flange 22, in turn, is fastened by two fastening screws 48, passed through countersunk fastening boreholes 46 in the specified fastening position, in which the outer surface of the boundary wall 34 lies against the peripheral wall of the recess 60.

If now the door leaf is to be adjusted relative to the front side of the carcase of a cabinet, cupboard or wardrobe, only the fastening screw 42 of the hinge pots 18 of the hinge 10, which fastens the door leaf to the carcase of the cabinet, cupboard or wardrobe, is loosened, so that the desired adjustment by shifting the door leaf is possible within the scope of the dimensions given by the length of the longitudinal hole on the one hand and the overdimension of the recess 16 above the trough-like pot part 20 on the other. The adjustment made is then fixed by tightening the fastening screw 42.

In order to prevent the pot part 20 from shifting unintentionally under the influence of the weight of the door leaf 12 relative to the fastening flange 22 also at right angles, that is, in the height direction, when the fastening screw 42 is loosened, elongated, strip-shaped guiding surfaces, extending on opposite sides of and parallel to the elongated hole 40, are formed at the fastening flange 22 and at the pot part 20. These guiding surfaces are formed, on the one hand, by lateral boundary walls 50 of the centering section 32, adjoining the boundary wall 34, and by associated wall regions 52 of the pot part. These mutually adjoining strip-shaped guiding surfaces thus ensure that, when the fastening screws are loosened, an adjustment is possible only in the intended adjusting direction. Twisting of the pot part relative to the fastening is also prevented.

As can be recognized furthermore in FIG. 2, the end sections of the covering flange 26 of the pot part 20 on the fastening-flange side engage suitable cutouts 29 in the fastening flange sections 28 facing the front edge of the door leaf and are then supported additionally within the fastening flange sections at their underside. Stresses, which would tend to lever the pot part 20 out of the recess 16, are thus transferred not only over the tab 36 of the pot part 20 to the underside of the connecting section 30 of the fastening flange 22, but also over the end sections of the covering flange 26 into the fastening flange sections on the fastening flange 22.

It is evident that, within the scope of the inventive concept, modifications and further developments of the specially described example are possible, which can relate, for example, to the manner in which the fastening flange 22 is fastened to the door leaf 12. Instead of the fastening screws 48, screwed with their threaded shafts directly into the material of the door leaf, it is also possible to provide expandable or overdimensioned fastening pegs at the fastening flange 22, which can be pre-installed either on the fastening flange or in appropriately assigned fastening openings in the door leaf 12. Instead of the described horizontal adjustment of the door leaf relative to the carcase of the cabinet, cupboard or wardrobe, a height adjustment of the door leaf 12 in the area of the hinge pot can also be realized by an elongated hole, offset by 90°. Even an adjustment in the horizontal as well as in the vertical direction is conceivable if, instead of the elongated hole 40, an opening is provided in the centering section 32, which enables to pot part 20 to be shifted in both directions relative to the fastening flange. The pot part 20 and/or the fastening flange 22 can also be produced from metal by die-casting. In special cases, production from plastics, which can be stressed sufficiently, and, if necessary, are reinforced, may also come into consideration.

We claim:

1. A furniture hinge for pivotally connecting a door leaf to the carcase of a cabinet, cupboard or wardrobe, comprising:

a door-related hinge member being coupled by a joint mechanism with a carcase related hinge member, the door-related hinge member being constructed as a hinge pot, said hinge pot comprising a pot part, insertable within a recess in the door leaf opening to an inside surface thereof, and being dimensioned smaller than the recess in such a manner that, in a unfastened state, the pot part is shiftable by a specified amount at least at fight angles to a border edge of the door leaf, said pot part comprising a central, trough-like, recessed middle part, having a bottom and also an upper edge from which a plane covering flange protrudes, which covers the space between a middle part and a peripheral wall of the recess in the door leaf, and lies at least within a radial, outer edge region on the inside surface of the door leaf;

a fastening flange for placement over a region of the inside surface of the door leaf by fastening means, which are engageable with the material of the door leaf; and wherein the pot part and the fastening flange each have plane-connecting sections such that fastening flange may be superimposed over and brought into contact with the pot part, and such that the pot part is shiftable in at least one direction relative to the fastening flange; and wherein a threaded borehole is provided in one of the plane-connecting sections and an opening is provided in an associated region of the other plane-connecting section, which is dimensioned larger than the diameter of the threaded borehole in at least the shiftable direction; and wherein the plane-connecting sections are joined by a fastening screw, the shaft of which is passed through the opening in the one plane connecting section into the threaded borehole of the other plane-connecting section, and which presses the plane-connecting sections together when tightened.

2. The furniture hinge according to claim 1, wherein the opening formed in the second plane connecting section of the fastening flange is an elongated hole, having a width which is substantially the same or slightly larger than the diameter of the shaft of fastening screw.

3. The furniture hinge according to claim 2, wherein the elongated hole extends at right angles in a lengthwise direction of the fastening flange, which is placeable parallel to a border edge of an associated door leaf facing the carcase.

4. The furniture hinge according to claim 3, wherein the plane connecting sections of the pot part and of the fastening flange, further comprise strip-shaped guiding surfaces extending at right angles to the border edge of the door leaf on opposite sides and parallel to the longitudinal extent of the elongated hole, which lie in contact with one another such that the pot part and the fastening flange can be shifted relative to one another in a sliding manner.

5. The furniture hinge according to claim 1, wherein the first and second plane connecting sections each further comprise a mutually facing flat side, and having projections and depressions for mutually engaging one another when the fastening screw is tightened, provided in the mutually facing flat sides of the plane connecting sections.

6. The furniture hinge according to claim 5, wherein the mutually engaging projections and depressions are pointed in cross-section and are formed by parallel complementary furrows, which extend at right angles to the adjusting direction.

7. The furniture hinge according to claim 1, wherein the fastening flange further comprises two fastening flange sections which protrude on opposite sides of the pot part in relation to a central plane running at right angles to a lengthwise direction of the fastening flange and which are integrally connected with one another through the second plane connecting section of the fastening flange.

8. The furniture hinge according to claim 7, wherein the second plane connecting section the fastening flange has a centering section, which is offset in the direction of the bottom of the recess, and in that a boundary wall of the centering section is formed in a partial region complementary to the boundary of the opposite region of a peripheral wall of the recess.

9. The furniture hinge according to claim 1, wherein the first plane connecting section, provided at the pot part, comprises a tab which is offset relative to the bottom of the trough-like, recessed middle part in the direction of the connecting section and extends parallel to the connecting section.

10. The furniture hinge according to claim 9, wherein the tab is offset, in relation to the bottom of the middle part of the pot part, such that an upper side of the tab lies against the underside of the connecting section of the fastening flange, and wherein the threaded borehole is provided in the tab and the elongated hole is provided in the plane connecting section of the fastening flange.

11. The furniture hinge according to claim 1, wherein the end sections of the covering flange engage complementary cutouts in the boundary surfaces facing the front edge of the door leaf and in the underside of the fastening flange.

* * * * *